US010046469B2

(12) United States Patent
Godlieb et al.

(10) Patent No.: US 10,046,469 B2
(45) Date of Patent: Aug. 14, 2018

(54) SHAVING APPARATUS AS WELL AS A CUTTING UNIT FOR SUCH A SHAVING APPARATUS

(71) Applicant: KONINKLIJKE PHILIPS N.V., Eindhoven (NL)

(72) Inventors: Robert Godlieb, Eindhoven (NL); Jasper Zuidervaart, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 117 days.

(21) Appl. No.: 14/777,786

(22) PCT Filed: Mar. 12, 2014

(86) PCT No.: PCT/IB2014/059665

§ 371 (c)(1),
(2) Date: Sep. 17, 2015

(87) PCT Pub. No.: WO2014/147520

PCT Pub. Date: Sep. 25, 2014

(65) Prior Publication Data

US 2016/0279814 A1 Sep. 29, 2016

Related U.S. Application Data

(60) Provisional application No. 61/804,248, filed on Mar. 22, 2013.

(51) Int. Cl.
*B26B 19/14* (2006.01)
*B26B 19/38* (2006.01)

(52) U.S. Cl.
CPC ..... *B26B 19/143* (2013.01); *B26B 19/384* (2013.01)

(58) Field of Classification Search
CPC ..... B26B 19/143; B26B 19/384
See application file for complete search history.

(56) References Cited

U.S. PATENT DOCUMENTS 2,877,548 A 3/1959 Starre
3,064,349 A 11/1962 Fütterer
3,281,937 A * 11/1966 Driessen ..... B26B 19/384 30/346.51

(Continued)

FOREIGN PATENT DOCUMENTS

EP 0428211 A1 5/1991
EP 1182014 A2 2/2002
WO 9745235 A1 12/1997

*Primary Examiner* — Hwei C Payer

(57) ABSTRACT

A shaving apparatus provided with at least one cutting unit including external and internal cutting members drivable relative to each other. The internal cutting member includes at least one cutting element with a cutting edge movable along a cutting path while being driven in a driving direction. The external cutting member includes at least one hair-entry aperture bounded by at least first and second wall portions of the external cutting member, at least the first wall portion having a cutting edge for cooperation with the internal cutting member cutting edge. An edge portion of the second wall portion facing a plane along the cutting path, in a cross section taken substantially perpendicularly to the plane along the cutting path, touches a virtual circle in at least two contact points on the virtual circle.

13 Claims, 5 Drawing Sheets

(56) References Cited

U.S. PATENT DOCUMENTS

| | | | | |
|---|---|---|---|---|
| 4,707,923 | A * | 11/1987 | Tietjens | B26B 19/141 30/346.51 |
| 4,998,352 | A | 3/1991 | Tietjens | |
| 5,119,558 | A * | 6/1992 | Van Erp | B26B 19/384 30/346.51 |
| 5,544,414 | A | 8/1996 | Dekker | |
| 6,515,256 | B1 * | 2/2003 | Battaglia | B23K 26/0846 219/121.72 |
| 7,540,090 | B2 * | 6/2009 | Nakano | B26B 19/141 30/346.51 |
| 2008/0148573 | A1 | 6/2008 | Nakano | |
| 2016/0279814 | A1 * | 9/2016 | Godlieb | B26B 19/384 |

* cited by examiner

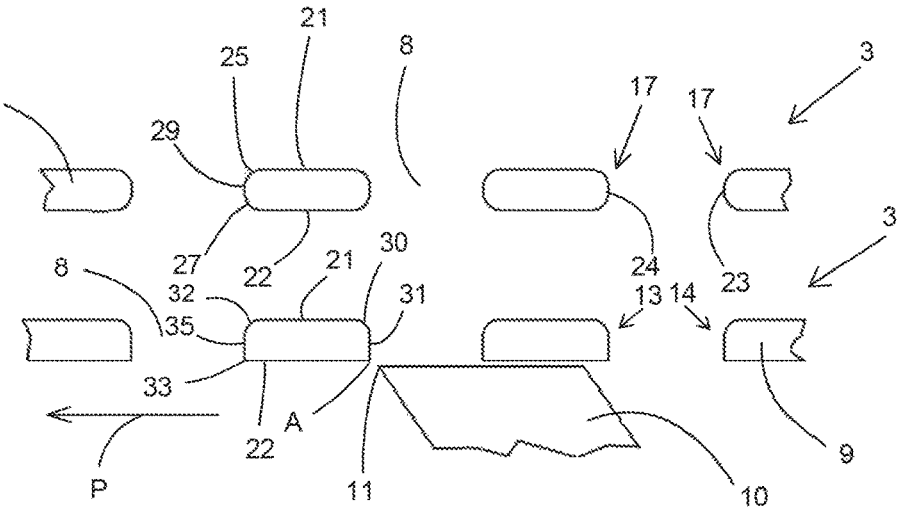
Fig. 4A
Fig. 5A
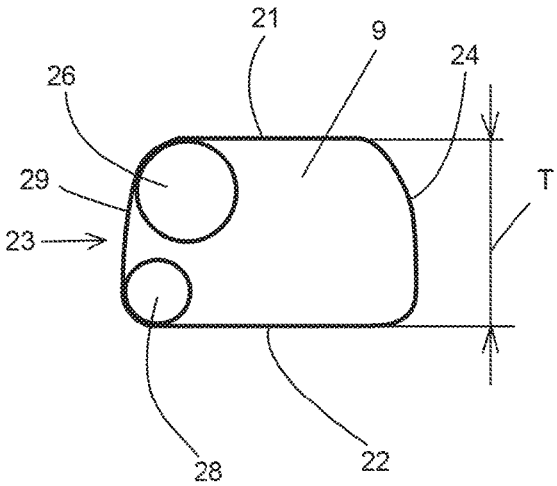
Fig. 4B
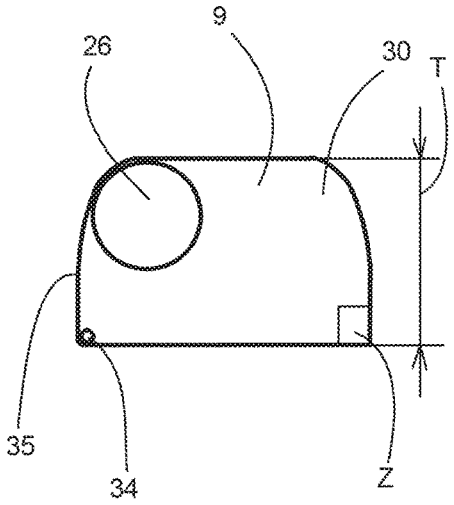
Fig. 5B

SHAVING APPARATUS AS WELL AS A CUTTING UNIT FOR SUCH A SHAVING APPARATUS

This application is the U.S. National Phase application under 35 U.S.C. § 371 of International Application No. PCT/IB2014/059665, filed on Mar. 12, 2014, which claims the benefit of U.S. Provisional Application 61/804,248 filed Mar. 22, 2013. These applications are hereby incorporated by reference herein.

FIELD OF THE INVENTION

The invention relates to a shaving apparatus provided with at least one cutting unit comprising an external cutting member and an internal cutting member which is drivable relative to the external cutting member in at least one driving direction, which internal cutting member comprises at least one cutting element comprising a cutting edge being movable along a cutting path, whilst being driven in the at least one driving direction, which external cutting member comprises at least one hair-entry aperture which is bounded by at least a first and a second wall portion of the external cutting member, at least the first wall portion comprising a cutting edge for cooperation with the cutting edge of the internal cutting member.

The invention also relates to a cutting unit for such a shaving apparatus.

BACKGROUND OF THE INVENTION

US2008/0148573 shows a rotary type electric shaver comprising an outer cutter having a shaving surface on an upper surface of a ring-shaped thin layer portion thereof and an inner cutter rotationally making sliding contact from below with the lower surface of the thin layer portion of the outer cutter. Hair introduction openings are formed in the thin layer portion. Whilst the shaving surface is being moved over the skin of a user, hairs are introduced in the openings and are cut by the cooperation between a cutter edge of the rotating internal cutter and a cutter edge of the outer cutter. The hair introduction opening is wide at the upper surface and narrow at the lower surface due to opposed projecting edges.

Due to the shape of the hair introduction opening, there is a risk of snagging and pulling of the hairs, and so loss of comfort.

SUMMARY OF THE INVENTION

In view of the above-mentioned and other drawbacks of the prior art, a general object of the present invention is to provide a shaver that alleviates the risk of snagging and pulling of hairs.

According to a first aspect, the invention provides a shaving apparatus of a type mentioned in the opening paragraph, wherein at least an edge portion of the second wall portion facing a plane comprising the cutting path, in a cross section taken substantially perpendicularly to the plane comprising the cutting path, touches a virtual circle with a radius of at least 30 micrometer at at least two contact points on the virtual circle, and wherein the tangents at two successive contact points where the edge portion touches the virtual circle, enclose an angle of at least 150 degrees.

With such a cross section, the edge portion of the second wall portion facing the plane comprising the cutting path gradually transits from a lower side of the external cutting member directed towards the internal cutting member, to a part of the second wall portion extending towards an upper side of the external cutting member. Due to the gradual transition, the risk of snagging and pulling of hairs is reduced, thus reducing the amount of skin irritation experienced by the user.

As regards an edge portion of the second wall portion having a constant radius of curvature, it will touch the virtual circle along the whole of the edge portion, whereby at two adjacent contact points the tangents at these contact points will enclose an angle of nearly 180 degrees.

According to a further aspect, the invention provides a shaving apparatus wherein the edge portion of the second wall portion, seen in a direction perpendicular to the driving direction, extends beyond the cutting path of the cutting edge of the internal cutting member.

As the hair-entry apertures of the shaving apparatus extend beyond the cutting path, the wall portions bounding such a hair-entry aperture and being located beyond the cutting path will not cooperate with the cutting edge of the internal cutting member. Preferably, at all these wall portions, the edge portion facing the plane comprising the cutting path gradually transits from the lower side of the external cutting member to a part of the second wall portion extending towards the upper side of the external cutting member.

The distance between the lower and the upper side of the external cutting member defines the thickness of the external cutting member. The gradual transition enables a larger thickness of the external cutting member by enlarging an effective width of the aperture in the driving direction for a hair that is poking through the aperture, thus reducing the chance of jamming or snagging. There are applications where such a thicker external cutting member with a thickness of for example more than 120 micrometer is desirable. This might be the case when designing a shaving apparatus for some market segments, where it is used for consistently cutting above the skin surface. Such a shaving apparatus is intended to reduce the occurrence of trapped or ingrown hairs with the associated skin irritations. The hypothesis is that, depending on skin characteristics of an individual, a hair that is cut too close to skin level has a higher likelihood of becoming trapped in the follicle when growing.

According to a further aspect, the invention provides a shaving apparatus, wherein the shaving apparatus is a rotary type shaving apparatus, wherein the internal cutting member is drivable relative to the external cutting member in a single rotating driving direction, wherein the edge portion of the second wall portion, seen in a direction perpendicular to the driving direction, is located within the cutting path of the cutting edge of the internal cutting member and opposite to the first wall portion.

During rotation of the internal cutting member, the cutting edge of the internal cutting member first passes the edge portion of the second wall portion before reaching and cooperating with the cutting edge of the first wall portion. Considering the relative movements of the internal cutting member and the external cutting member, the second wall portion forms a leading wall portion, whilst the first wall portion forms a trailing wall portion.

Preferably, the edge portion of the leading wall portion gradually transits from the lower side of the external cutting member to a part of the wall portion extending towards the upper side of the external cutting member over the full width of the cutting path in a direction perpendicular to the driving direction.

Even more preferably, the second wall portion extends between a first and a second end of the first wall portion or the second wall portion ends relatively close to the first and the second end of the first wall portion.

According to a further aspect, the invention provides a shaving apparatus wherein the edge portion of the second wall portion facing the plane comprising the cutting path has a radius of curvature of at least 40 micrometer.

An edge portion with such a radius can easily be manufactured on the second wall portion.

According to a further aspect, the invention provides a shaving apparatus wherein the edge portion of the second wall portion facing the plane comprising the cutting path comprises a number of segments, wherein the segment in the cross section taken substantially perpendicularly to the plane comprising the cutting path, touches the virtual circle with the radius of at least 30 micrometer at at least two contact points, wherein the tangents at two successive contact points where the segments touch the virtual circle, enclose an angle of at least 150 degrees.

With such segments, the edge portion gradually transits from the lower side of the external cutting member directed towards the internal cutting member, to a part of the second wall portion extending towards the upper side of the external cutting member. In case such a part extends perpendicularly to the cutting path, the edge portion may comprise two flat segments extending at an angle of 150 degrees with respect to each other. Furthermore, one segment extends at an angle of 150 degrees from the lower side, whilst the other segment extends at an angle of 150 degrees from the part of the second wall portion extending towards the upper side of the external cutting member.

According to a further aspect, the invention provides a shaving apparatus wherein, at least near the cutting path, the first wall portion and the second wall portion are connected to each other by an intermediate wall portion forming a gradual transition from the cutting edge of the first wall portion to the edge portion of the second wall portion facing the plane comprising the cutting path.

The intermediate wall portion prevents an abrupt, sharp transition from the cutting edge of the first wall portion to the edge portion of the second portion wall portion. This gradual transition can be obtained, for example by gradually changing the radius of the edge portion of the intermediate wall portion from the dimension of the cutting edge to the radius of the virtual circle. The length of the intermediate wall portion between the first wall portion and the second wall portion can be about the radius of the virtual circle.

According to a further aspect, the invention provides a shaving apparatus, wherein in a cross section taken substantially perpendicularly to the plane comprising the cutting path, the cutting edge of the first wall portion touches, at at least two contact points, a virtual circle with a radius of less than half the radius of the virtual circle touched by the edge portion of the second wall portion.

With such a ratio between the radii, a sharp cutting edge of the first wall portion and a gradual transition of the edge portion of the second wall portion are obtained.

According to a further aspect, the invention provides a shaving apparatus wherein the virtual circle touched by the cutting edge of the first wall portion has a radius of less than 15 micrometer.

Such a relatively small radius of the virtual circle results in a sharp cutting edge.

According to a further aspect, the invention provides a shaving apparatus wherein the cutting edge of the first wall portion, in a cross section taken substantially perpendicularly to the plane comprising the cutting path, includes an angle of 90 degrees or less.

By virtue of such an angle, a sharp cutting edge is obtained.

BRIEF DESCRIPTION OF THE DRAWINGS

These and other aspects of the invention will now be described in more detail, with reference to the appended drawings showing currently preferred embodiments of the invention, wherein:

FIGS. 5A and 5B show, respectively, a cross section and an enlarged cross section of a part of the cutting unit as shown in FIG. 3, in the direction of arrows V-V.

In the figures, the same reference numbers are used for corresponding elements.

DESCRIPTION OF PREFERRED EMBODIMENTS

Figure 1:
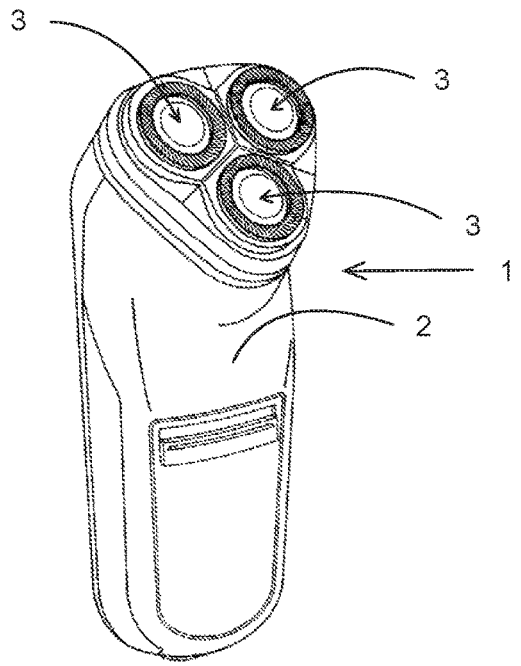
FIG. 1 shows a perspective view of a first embodiment of a shaving apparatus according to the invention.

FIGS. 1-5A show different views of a first embodiment of a shaving apparatus 1 according to the invention. The shaving apparatus 1 comprises a housing 2 with three cutting units 3. Each cutting unit 3 comprises an external cutting member 4 and an internal cutting member 5. The internal cutting member 5 is rotatably drivable relative to the external shaving member 4 about a central axis 6 in a direction indicated by arrow P. In a known manner, the internal shaving member 5 can be driven by means of an electric motor, not shown, which is accommodated in the housing 2.

The external cutting member 4 has a substantially annular wall portion 7 with a number of elongated hair-entry apertures 8 extending in the radial direction over a length L1. Between each pair of two adjacent hair-entry apertures 8, an elongated lamella 9 extending in the radial direction is located.

The internal cutting member 5 comprises a number of cutting elements 10 each comprising a cutting edge 11 extending in the radial direction over a length L2. The length L2 is smaller than the length L1. When the internal cutting member 5 is driven in the direction indicated by arrow P, the cutting edge 11 is moved along a cutting path 12 having a width equal to the length L2 of the cutting edge 11.

The hitherto described shaving apparatus 1 is known per se and will not be further described.

Figure 2:
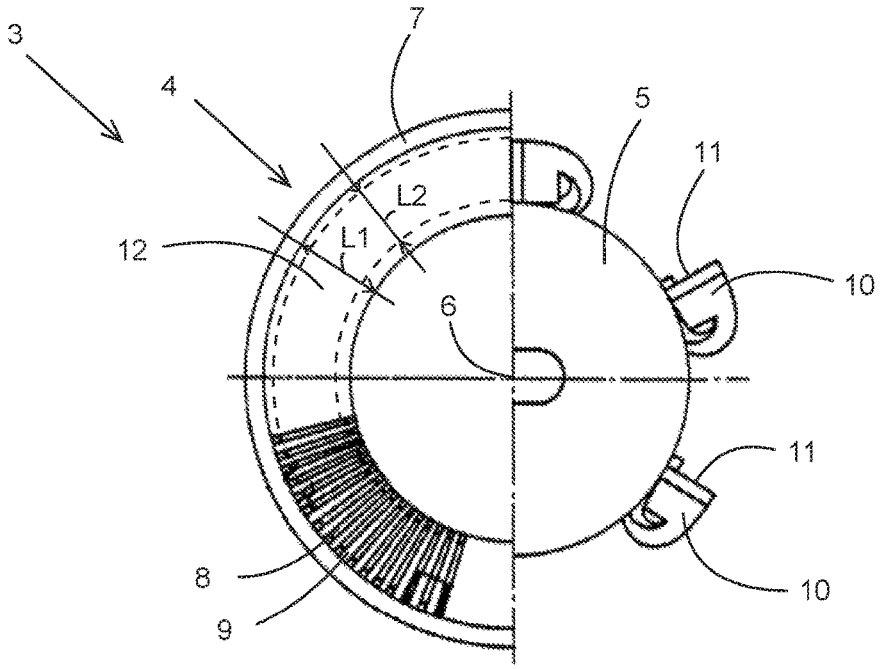
FIG. 2 shows partially in cross section, a cutting unit of the shaving apparatus as shown in FIG. 1.
Figure 3:
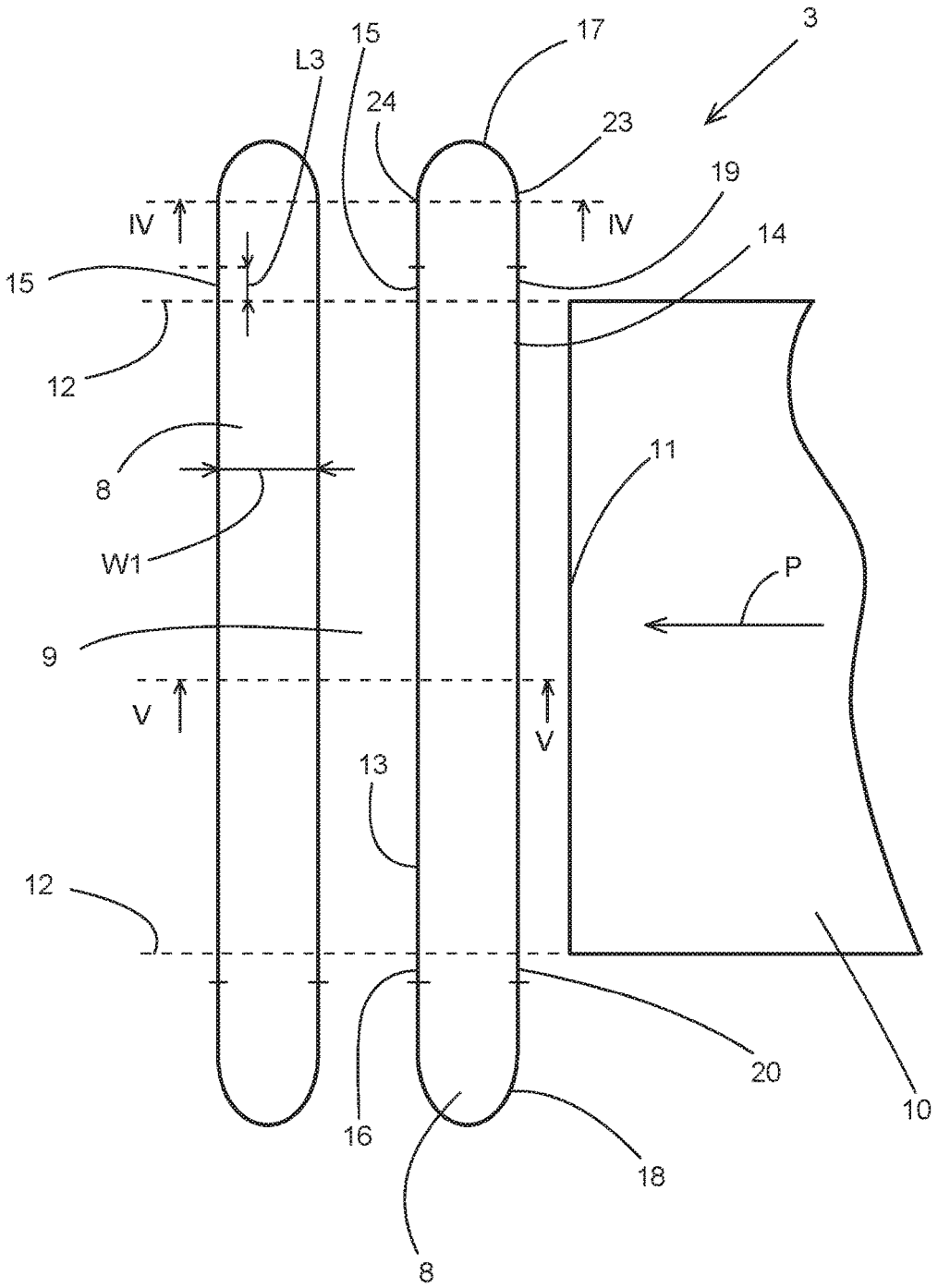
FIG. 3 shows an enlarged schematic top view of a part of the cutting unit as shown in FIG. 2, FIGS. 4A and 4B show, respectively, a cross section and an enlarged cross section of a part of the cutting unit as shown in FIG. 3, in the direction of arrows IV-IV.

FIG. 3 shows an enlarged schematic top view of the cutting unit 3 as shown in FIG. 2. Each elongated hair-entry aperture 8 is bounded in the direction indicated by arrow P, by a trailing wall portion 13 extending in a direction perpendicular to the direction indicated by arrow P and a leading wall portion 14 extending parallel to the trailing wall portion 13 at a distance W1 thereof. Seen in the direction of the arrow P, the cutting edge 11 will first pass the leading wall portion 14 before passing the trailing wall portion 13. The trailing wall portion 13 is connected at each end to an intermediate wall portion 15, 16. Each intermediate wall portion 15, 16 is connected, at an end thereof remote from the trailing wall portion 13, to a curved wall portion 17, 18. Each curved wall portion 17, 18 is connected, at an end remote from the intermediate wall portion 15, 16, to an intermediate wall portion 19, 20. Each intermediate wall portion 19, 20 is connected, at an end remote from the respective curved wall portion 17, 18, to opposite ends of the leading wall portion 14.

The intermediate wall portions 15, 16, 19, 20 have a length L3 in the direction perpendicular to the direction indicated by arrow P.

As can be seen in FIG. 3, the cutting edge 11 will move past the leading wall portion 14 and the trailing wall portion 13 but will not move past the intermediate wall portions 15, 16, 19, 20 and the curved wall portions 17, 18.

FIGS. 4A-4B show, respectively, a cross section and an enlarged cross section of the cutting unit 3 at the curved wall portion 17 in the direction of arrows IV-IV of FIG. 3.

The lamella 9 between the apertures 8 comprises an upper side 21 and a lower side 22 extending parallel to the upper side 21, parallel to the cutting path 12 and spaced apart from said upper side by the thickness T. Preferably, the thickness T is between 80 and 200 micrometer.

The curved wall portion 17 comprises a leading part 23 and a trailing part 24, which parts extend between the lower side 22 and the upper side 21.

As can best be seen in FIG. 4B, the shape of the leading part 23 and the trailing part 24 are similar and comprise a rounded upper edge portion 25 following partly an upper virtual circle 26, a rounded lower edge portion 27 following partly a lower virtual circle 28 and a flat part 29 extending between the rounded upper edge portion 25 and the rounded lower edge portion 27. The flat part 29 encloses a sharp angle with the lower side 22. The rounded edge portions 25, 27 touch the respective virtual circles 26, 28 along the whole of the rounded edge portions 25, 27 at a number of contact points, wherein the tangents at two successive contact points on the virtual circle 26, 28 enclose an angle of about 180 degrees. The lower edge portion 27 faces a plane comprising the cutting path 12. However, the lower edge portion 27 seen in a direction perpendicular to the driving direction indicated by arrow P, is located outside the cutting path 12. The upper virtual circle 26 has a radius of for example 50 micrometer, whilst the lower virtual circle 28 has a radius of for example 30 micrometer. The radius of the lower virtual circle 28 may also be larger than 30 micrometer, or even larger than 40 micrometer.

FIGS. 5A-5B show, respectively, a cross section and an enlarged cross section of the cutting unit 3 at the trailing and leading portions 13, 14 in the direction of arrows V-V of FIG. 3.

As can best be seen in FIG. 5B, the shape of the trailing and leading portions 13, 14 near the upper side 21 are similar to each other and are similar to the shape of the leading part 23 and the shape of the trailing part 24 near the upper side 21. The trailing portion 13 comprises a rounded upper edge portion 30 following partly the upper virtual circle 26. The trailing portion 13 also comprises a flat part 31 extending between the rounded upper edge portion 30 and the lower side 22. The flat part 31 extends substantially perpendicularly to the lower side 22 and encloses a sharp angle A of about 90 degrees with the lower side 22. The transition between the flat part 31 and the lower side 22 forms a cutting edge of the lamella 9.

The leading portion 14 comprises a rounded upper edge portion 32 following partly the upper virtual circle 26, a rounded lower edge portion 33 following partly a lower virtual circle 34 and a flat part 35 extending between the rounded upper edge portion 32 and the rounded lower edge portion 33. The rounded edge portions 32, 33 touch the respective virtual circles 26, 34 along the whole of the rounded edge portions 32, 33 at a number of contact points, wherein the tangents at two successive contact points on the virtual circle 26, 34 enclose an angle of about 180 degrees. The lower virtual circle 34 has a radius of for example 15 micrometer. The radius of the lower virtual circle 34 may also be less than 15 micrometer.

Over the length L3 in the direction perpendicular to the direction indicated by arrow P, the intermediate wall portions 15, 16, 19, 20 have a radius that gradually changes from, respectively, 15 micrometer and 0 micrometer of the leading part 23 and the trailing part 24 to 30 micrometer of the leading part 23 and the trailing part 24. The length L3 is preferably larger than the largest radius, i.e. larger than 30 micrometer.

Figure 6:
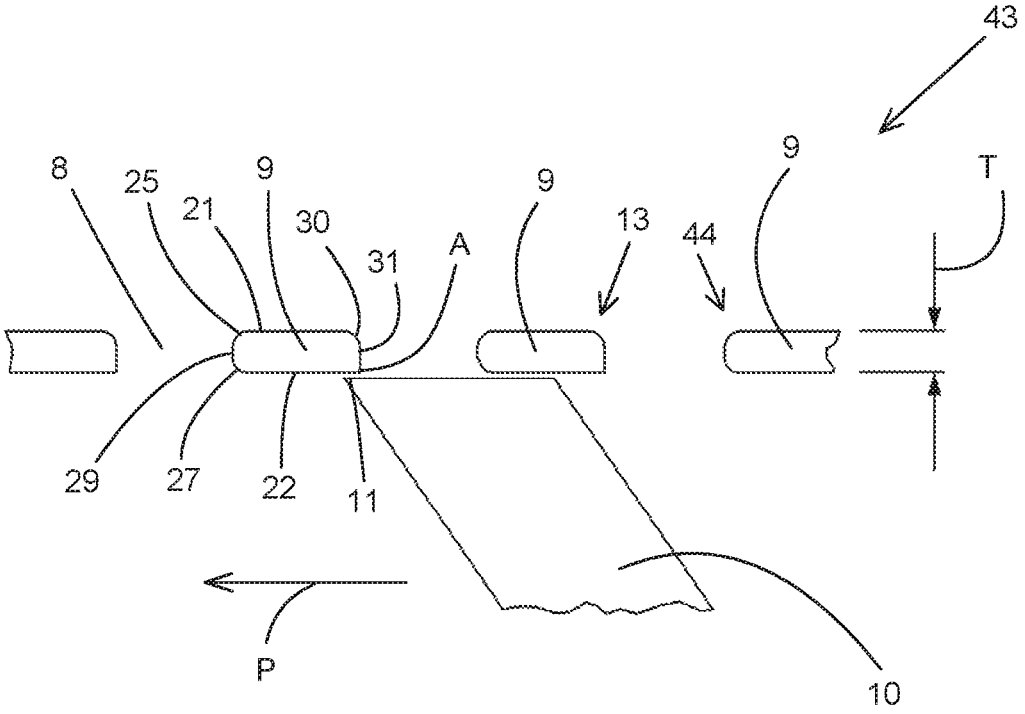
FIG. 6 shows a cross section of a second embodiment of a cutting unit according to the invention.

FIG. 6 shows a cross section of a second embodiment of a cutting unit 43 according to the invention, which only differs from the first embodiment as shown in the FIGS. 1-5B, in that the leading wall portion 44 of the cutting unit 43 is similar to the leading part 23 of the cutting unit 3, and comprises a rounded upper edge portion 25 following partly the upper virtual circle 26, a rounded lower edge portion 27 following partly the lower virtual circle 28 and a flat part 29 extending between the rounded upper edge portion 25 and the rounded lower edge portion 27. The rounded edge portions 25, 27 touch the respective virtual circles 26, 28 along the whole of the rounded edge portions 25, 27 at a number of contact points, wherein the tangents of two successive contact points on the virtual circle 26, 28 enclose an angle of about 180 degrees. The lower virtual circle 28 has a radius of for example 30 micrometer. The radius of the lower virtual circle 28 may also be larger than 30 micrometer, or even larger than 40 micrometer.

The wall portions 13 form a first wall portion whilst the wall portions 15-20, 44 form second wall portions.

Figure 7:
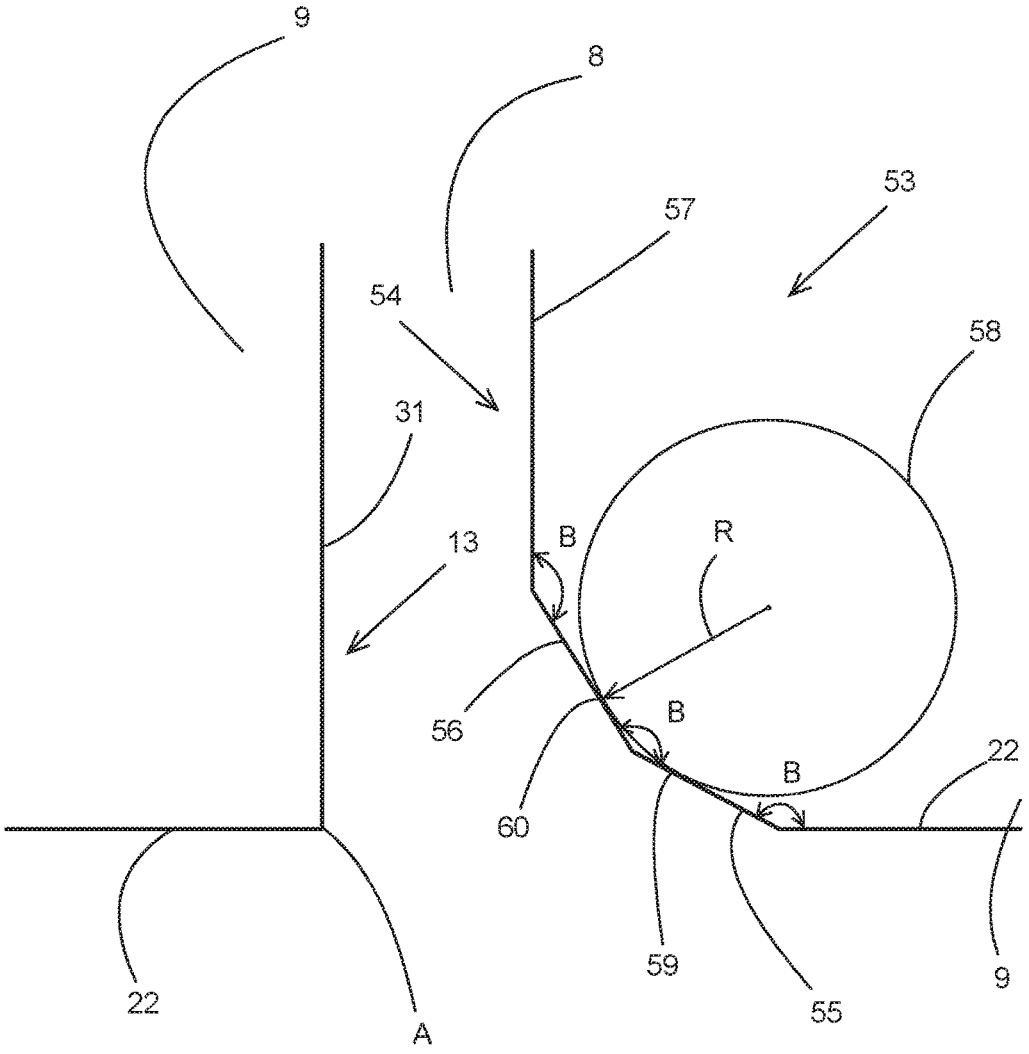
FIG. 7 shows a detailed cross section of a third embodiment of a cutting unit according to the invention.

FIG. 7 shows a cross section of a third embodiment of a cutting unit 53 according to the invention, which only differs from the first embodiment as shown in the FIGS. 1-5B, by the shape of the second wall portions. In FIG. 7, a part of a trailing wall portion 13 and the opposite leading wall portion 54 are shown. The leading wall portion 54 comprises a rounded upper edge portion 25 (not shown) following partly an upper virtual circle similar to FIGS. 5A, 5B and 6. The leading wall portion 54 comprises a first and a second flat segment 55, 56. The first flat segment 55 is connected to the lower side 22 and encloses an angle B therewith. On a side opposite to the lower side 22, the first flat segment 55 is connected to the second flat segment 56 and encloses an angle B therewith. On a side opposite to the first flat segment 55, the second flat segment 56 is connected to a flat part 57 and encloses an angle B therewith. The angle B is 150 degrees, due to which the lower side 22 and the flat part 57 extend perpendicularly to each other.

The flat segments 55, 56 touch a virtual circle 58 with a radius R of 30 micrometer at two contact points 59, 60. In this case, the tangents at the contact points 59, 60 on the virtual circle 58 are parallel to the segments 55, 56 and enclose an angle B of 150 degrees with each other.

The wall portion 54 forms a second wall portion, and the shape of the second wall portion 54 can also be used as the shape of the curved wall portions 17, 18. The leading portion 14 forms a third wall portion, not comprising a cutting edge and not comprising the gradual transition. However, preferably all wall portions except the trailing wall portion with the cutting edge, have a gradually changing edge portion.

When using the shaving apparatus, the user places the upper sides 21 of the cutting units 3, 43, 53 against his skin, so that hairs will go through the apertures 8. By rotating the cutting elements 10 with the cutting edge 11, hairs will be cut by the interaction between the cutting edge 11 of the internal cutting member 5 and the sharp angle A forming a cutting edge of the external cutting member 4. Due to the second wall portions, the risk of snagging and pulling of hairs is largely reduced, even with a relative large thickness T of the external cutting member 4.

The segments 55, 56 may include larger angles and more than two segments can be used.

The flat part 57 may extend at a sharp or obtuse angle with respect to the lower side 22.

The width W1 of the aperture 8 between two lamellae 9 can be larger but also smaller than the thickness T of the lamella 9 as long as the skin itself will not get into the cutting path 12.

The apertures 8 can also extend at an angle with respect to the radial direction or be curved in a plane through the cutting path 12.

The apertures 8 can have other shapes, such as slots, holes, curved slots or more complex forms.

Whilst the invention has been described in terms of a clear distinction between inside and outside the cutting path and first, intermediate, second and third wall portions, these distinctions can in practice be less absolute and stochastic in nature. Given, inter alia, manufacturing tolerances and/or dynamic effects, individual cutting edges may be positioned outside of the nominal cutting path. Overall, the cutting edges will however on average be mostly in the nominal cutting path.

It is also possible to use such second wall portions in a vibratory shaving apparatus, wherein the wall portions outside the cutting path will be second wall portions as described above and are provided with the gradually changing edge portions.

It is also possible that only the wall portions outside or inside the cutting path form second wall portions.

It is also possible that there are no wall portions outside the cutting path, in which case a leading wall portion forms a second wall portion. In such a case, the internal cutting member will be driven in one driving direction only.

LIST OF REFERENCE SIGNS

1 shaving apparatus
2 housing
3 cutting unit
4 external cutting member
5 internal cutting member
6 central axis
7 annular wall portion
8 hair-entry aperture
9 lamella
10 cutting element
11 cutting edge
12 cutting path
13 wall portion
14 wall portion
15 wall portion
16 wall portion
17 wall portion
18 wall portion
19 wall portion
20 wall portion
21 upper side
22 lower side
23 leading part
24 trailing part
25 rounded upper edge portion
26 upper virtual circle
27 rounded lower edge portion
28 lower virtual circle
29 flat part
30 rounded upper edge portion
31 flat part
32 rounded upper edge portion
33 rounded lower edge portion
34 lower virtual circle
35 flat part
43 cutting unit
44 leading wall portion
53 cutting unit
54 leading wall portion
55 first flat segment
56 second flat segment
57 flat part
58 virtual circle
59 contact point
60 contact point
B angle
L1 length
L2 length
L3 length
P arrow
T thickness
W1 distance

The invention claimed is:

1. A cutting unit comprising an external cutting member and an internal cutting member which is drivable relative to the external cutting member in at least one driving direction, which internal cutting member comprises at least one cutting element comprising a cutting edge being movable along a cutting path whilst being driven in the at least one driving direction, which external cutting member comprises at least one hair-entry aperture which is bounded by at least a first wall portion and a second wall portion of the external cutting member, at least the first wall portion comprising a cutting edge for cooperation with the cutting edge of the internal cutting member, wherein at least an edge portion of the second wall portion facing a plane comprising the cutting path, in a cross section taken substantially perpendicularly to the plane comprising the cutting path, touches a virtual circle with a radius of at least 30 micrometer at at least two contact points on the virtual circle, and wherein tangents at two successive contact points of the at least two contact points where the edge portion touches the virtual circle, form and enclose an angle of at least 150 degrees.

2. The cutting unit according to claim 1, wherein the edge portion of the second wall portion, seen in a direction perpendicular to the driving direction, extends beyond the cutting path of the cutting edge of the internal cutting member.

3. The cutting unit according to claim 1, wherein the cutting unit is configured for a rotary type shaving apparatus, wherein the at least one driving direction is a single rotating driving direction, wherein the edge portion of the second wall portion, seen in a direction perpendicular to the rotating driving direction, is located within the cutting path of the cutting edge of the internal cutting member and opposite to the first wall portion.

4. The cutting unit according to claim 1, wherein the edge portion of the second wall portion has a radius of curvature of at least 40 micrometer.

5. The cutting unit according to claim 1, wherein the edge portion of the second wall portion facing the plane comprising the cutting path comprises a number of segments, wherein the segments in the cross section taken substantially perpendicularly to the plane comprising the cutting path, touch the virtual circle at the at least two contact points.

6. The cutting unit according to claim 1, wherein at least near the cutting path the first wall portion and the second wall portion are connected to each other by an intermediate wall portion forming a gradual transition from the cutting edge of the first wall portion to the edge portion of the second wall portion facing the plane comprising the cutting path.

7. The cutting unit according to claim 1, wherein the virtual circle is a first virtual circle and the edge portion is a first edge portion, wherein, in a cross section taken substantially perpendicularly to the plane comprising the cutting path, a second edge portion of the second wall portion touches, at at least two contact points a second virtual circle with a radius of less than half the radius of the first virtual circle touched by the first edge portion of the second wall portion.

8. The cutting unit according to claim 7, wherein the second virtual circle touched by the second edge portion of the second wall portion has a radius of less than 15 micrometer.

9. The cutting unit according to claim 1, wherein the cutting edge of the first wall portion, in a cross section taken substantially perpendicularly to the plane comprising the cutting path, includes an angle of 90 degrees or less.

10. A shaving apparatus provided with at least one cutting unit according to claim 1.

11. A cutting unit comprising an external cutting member and an internal cutting member which is drivable relative to the external cutting member in at least one driving direction, which internal cutting member comprises at least one cutting element comprising a cutting edge being movable along a cutting path whilst being driven in the at least one driving direction, which external cutting member comprises at least one hair-entry aperture which is bounded by at least a first wall portion and a second wall portion of the external cutting member, at least the first wall portion comprising a cutting edge for cooperation with the cutting edge of the internal cutting member, wherein at least an edge portion of the second wall portion facing a plane comprising the cutting path, in a cross section taken substantially perpendicularly to the plane comprising the cutting path, touches a virtual circle with a radius of at least 30 micrometer at at least two contact points of the at least two contact points on the virtual circle, and wherein tangents at two successive contact points where the edge portion of the second wall portion touches the virtual circle, enclose an angle of at least 150 degrees.

12. A cutting unit comprising an external cutting member and an internal cutting member which is drivable relative to the external cutting member in at least one driving direction, which internal cutting member comprises at least one cutting element comprising a cutting edge being movable along a cutting path whilst being driven in the at least one driving direction, which external cutting member comprises at least one hair-entry aperture which is bounded by at least a first wall portion and a second wall portion of the external cutting member, at least the first wall portion comprising a cutting edge for cooperation with the cutting edge of the internal cutting member, wherein at least a first edge portion of the second wall portion facing a plane comprising the cutting path, in a cross section taken substantially perpendicularly to the plane comprising the cutting path, touches a first virtual circle with a radius of at least 30 micrometer at at least two contact points on the first virtual circle, and wherein tangents at two successive contact points of the at least two contact points where the edge portion of the second wall portion touches the first virtual circle, enclose an angle of at least 150 degrees, wherein, in a cross section taken substantially perpendicularly to the plane comprising the cutting path, a second edge portion of the second wall portion touches, at at least two contact points of the at least two contact points a second virtual circle with a radius of less than half the radius of the first virtual circle touched by the first edge portion of the second wall portion.

13. The cutting unit according to claim 12, wherein the second virtual circle touched by the second edge portion of the second wall portion has a radius of less than 15 micrometer.

* * * * *